US005310380A

United States Patent [19]

Levy et al.

[11] Patent Number: 5,310,380

[45] Date of Patent: May 10, 1994

[54] ADJUSTABLE HEIGHT PLAY TOY WITH MOVABLE BODY PORTION

[76] Inventors: Richard C. Levy, P.O. Box 34828, Bethesda, Md. 20827; Gary Piaget, No. 48, 1435 W. Silvermeadows Dr., Park City, Utah 84060

[21] Appl. No.: 867,477

[22] Filed: Apr. 13, 1992

[51] Int. Cl.[5] ..... A63H 3/36

[52] U.S. Cl. ..... 446/489; 446/320; 446/370

[58] Field of Search ..... 446/320, 321, 489, 368, 446/197, 204, 207, 486, 369, 370; 248/160, 161, 125; 482/17

[56] References Cited

U.S. PATENT DOCUMENTS

| | | | |
|---|---|---|---|
| 2,527,007 | 10/1950 | Golino | 446/73 X |
| 2,767,516 | 10/1956 | Del Mas | 446/320 |
| 2,777,692 | 1/1957 | Marzucco | 482/17 |
| 2,815,605 | 12/1957 | Connell | 446/368 |
| 3,225,486 | 12/1965 | Levy | 446/22 |
| 3,293,783 | 12/1966 | Rosenfeld | 446/353 X |
| 3,319,846 | 5/1967 | Wolf | 223/68 |
| 3,442,045 | 5/1969 | Green | 446/297 |
| 3,645,038 | 2/1972 | Morrison et al. | 446/320 |
| 3,797,166 | 3/1974 | Murray | 446/320 |
| 3,828,467 | 8/1974 | Kaelin | 446/320 |
| 3,986,295 | 10/1976 | Keller . | |
| 3,995,394 | 12/1976 | Ayton | 446/320 |
| 4,246,722 | 1/1981 | Sapkus et al. | 446/320 |
| 4,518,367 | 5/1985 | Zaruba et al. | 446/373 |
| 4,540,378 | 9/1985 | Cusimano | 446/369 |
| 4,576,585 | 3/1986 | Balogh et al. | 446/199 |
| 4,622,021 | 11/1986 | Darrigo, Sr. | 446/320 |

OTHER PUBLICATIONS

"Blirds" Brochure, Ljn Toys Ltd.

*Primary Examiner*—Mickey Yu

*Attorney, Agent, or Firm*—Nixon & Vanderhye

[57] ABSTRACT

The toy figure includes a plurality of telescoping sections mounting a head portion and base portion for extension and retraction relative to one another. A body portion is mounted on the telescopic sections between the head and base portions and is moveable along the figure and retained in selected adjusted positions therealong independently of the telescoping action of the sections whereby the body portion can be disposed at any elevation between the head and base portions for any height of the figure.

4 Claims, 4 Drawing Sheets

ADJUSTABLE HEIGHT PLAY TOY WITH MOVABLE BODY PORTION

BACKGROUND AND SUMMARY OF THE INVENTION

The present invention relates to play toy figures extensible and retractable to enable the figures to grow or shorten in height, and particularly relates to toy figures having upper head and neck portions and lower leg and base portions wherein the neck and leg portions may be extended and shortened to heighten or shorten the play toy figure in combination with a body portion moveable along the neck and leg portions.

Many different play toys, such as dolls, are extensible and retractable to vary the height of the play toy figure. The mechanisms by which these figures are extended and retracted have included telescopic sections within the toy figure having friction devices engageable with the telescopic sections whereby the telescopic sections may be retained in selected adjustable positions, i.e., a selected height for the play toy figure. Toy figures of this type have, of course, brought interest and pleasure to small children and have been variously colorfully adorned and padded to simulate characters of various types.

According to the present invention, toy figures of the adjustable height type described above are provided an added feature, i.e., a body portion which is slidable along the figure between its base and head portions independently of the magnitude of the extension or shortening of the body of the figure itself. The toy figure of the present invention may therefore comprise an upper portion characterized by a head and a neck, a lower portion characterized by base and leg portions and a body portion which is moveable along the figure between positions adjacent the head and base portions independently of the degree of extension or shortening of the neck or leg portions. Additionally, by moving the body portion along the figure, the neck or leg portions afford the appearance of being extended or shortened without altering or changing the overall height of the toy figure. In a play toy figure, the body portion may be simulative of the stomach or "tummy" of a character. Its addition to and independent movement along the play toy figure which is adjustable in height adds considerable interest in and color to the toy figure and pleasure to children playing with the toy figure.

It will be appreciated that the various parts comprising the play toy figure hereof can be decorative. For example, the head portion may comprise a stuffed head with various characteristic facial features, for example, eyes, ears, nose or mouth, while the base portion, likewise can be decorative by simulating the feet of the figure. Similarly, the neck and leg portions may be covered with decorative overlays, respectively, preferably a fabric material, there being sufficient fabric to accommodate the movement of the telescopic sections of the figure and the movement of the body portion. The body portion, likewise, can be provided in a decorative material, preferably fabric, with or without enclosed stuffing, and may be provided with other appendages, such as arms or wings, similarly provided in decorative fashion. By securing the fabric of the neck portion between the head and slidable body portions and the fabric of the foot portion between the slidable body and the base portion, the mechanism within the play toy figure by which its height may be varied and the body portion moved up and down the figure are completely hidden from view.

To accomplish the foregoing, the toy figure is comprised of a plurality of structural sections telescopically receivable one within the other. The upper ends of the sections are provided with stops so that the sections cannot be withdrawn from their telescopic relation one to the other. Also, friction pads are provided between adjacent telescopic sections so that the sections can be extended or retracted relative to one another with the friction pads maintaining the sections in the selected telescopically adjusted position. More particularly, there is provided at least an upper telescopic section having a flange at its upper end on which the head of the figure may be mounted. The upper section is telescopically receivable within a lower section carrying the base portion of the figure. Additional sections may be telescopically disposed between the upper and lower telescopic sections as desired.

It is a significant feature of the present invention that the body portion intermediate the head and base portions may be moveable along the figure independently of the height of the figure, i.e., independently of the number and telescopic extent of the telescopic sections by which the height of the figure is adjusted. Thus, the body portion is moveable and maintained in a selected position along the figure between positions directly adjacent the head and base portions and any intermediate position therebetween and without regard to the height of the figure. To accomplish this, the body portion is comprised of an inner sleeve which is not attached to but is biased radially inwardly into frictional engagement about the telescopic sections. The radial inward bias of the sleeve about the telescopic sections enables the body portion to be frictionally maintained in selected positions along the figure.

To provide this inward bias, the body portion may have a stuffing, formed of resilient material, about the sleeve, which, not only forms part of the decorative portion of the figure, but functionally serves to maintain the sleeve compressed about the telescopic sections. Alternatively, the sleeve may be formed of an elastic material or may only have portions about the sleeve formed of an elastic material whereby the elastic material causes the sleeve to frictionally bind along the telescopic sections to frictionally retain the body portion in selected adjusted positions.

In one form of the present invention, the telescopic sections are generally cylindrical in nature. Alternatively, the sections may comprise non-cylindrical cross-sections which provide additional structural strength and avoid crimping of the telescopic sections when extended. For example, the telescopic sections may have the cross-sectional shape of a star. Additionally, the friction pads by which the telescopic sections are maintained in selected position relative to one another may comprise shoes on diametrically opposite sides of the sections and which shoes are biased radially outwardly by a spring engaging between the pads. The spring may comprise a resilient plastic shaped part, for example, a Z-shaped plastic element or a helical spring.

It is a further significant feature of the present invention that the body portion is movable along the toy figure and that the toy figure may be adjusted in height while maintaining its decorative overlay of the telescopic sections between the body and head portions on the one hand and the body and base portions on the other hand. To accomplish this, two discrete decorative overlays are provided, respectively, one connected between the body and head portions and the other between the base and body portions. Each overlay, preferably in the form of a sheath of decorative fabric material, has sufficient material to enable movement of the body portion a maximum distance from the associated portion, i.e., either the head or base portion. Thus, the preferred decorative fabric sheath between the body and the head portions has sufficient extent in the direction of the height of the play toy to overlie the entire neck portion when the body portion is moved a maximum distance from the head portion, i.e., to a position adjacent the base portion. Likewise, the preferred decorative fabric sheath between the body and base portions has sufficient extent in the direction of the height of the play toy to overlie the entire leg portion when the body portion is moved a maximum distance from the base portion, i.e., to a position adjacent the head portion. Conversely, the decorative fabric sheaths are simply gathered or compressed when the body portion is moved toward the sheath and to a position directly adjacent the respective head and base portions.

In another form of the present invention, it is desirable to pivot the leg and base portions of the figure outwardly when the legs are in their extended position. To accomplish this, the leg portions are provided with elongated or rod-like elements which extend through ball and socket joints carried by the base section. When the figure is fully extended, the upper ends of the elongated elements are located in the ball joints enabling the leg portion and feet to pivot outwardly relative to the remaining portion of the figure. When the base section is lowered relative to the elements, the leg elements pass through the ball joints to extend into the upper telescoping sections.

In a preferred embodiment according to the present invention, there is provided a play toy comprising a toy body having a plurality of generally upright sections telescopically receivable one with the other, one of the sections having a base portion at its lower end and another of the sections having an upper portion whereby, upon telescopic movement of the sections, the upper portion and the base portion are movable toward and away from one another to render the play toy shorter or taller, respectively, means engagable between the sections for releasably retaining the sections in selected telescopically adjusted positions relative to one another whereby the upper portion and the base portion are disposable in selected adjusted distances relative to one another, a body portion moveable along the sections independently of the telescopic movement of the sections and toward and away from each of the upper portion and the base portion. Means are provided cooperable between the body portion and the sections for releasably retaining the body portion in selected adjustable positions along the sections.

In a further preferred embodiment according to the present invention, there is provided a play toy comprising a toy body having upper, lower and intermediate sections, the intermediate section connecting between the upper and lower sections and including a biased bellows whereby the upper and lower sections are moved toward and away from one another, with the bellows maintaining the upper and lower portions at selectively adjusted positions relative to one another, a body portion movable along the intermediate bellows portion independently of the movement of the head and base portions toward and away from one another whereby the body portion may be displaced into a selected adjusted position along the bellows of the intermediate portion and means cooperable between the body portion and the intermediate portion for releasably retaining the body portion in selected adjustable positions along the intermediate portion.

Accordingly, it is a primary object of the present invention to provide a novel and improved play toy figure which may be extended or shortened to selectively adjust the height of the figure and which play toy figure has a body portion moveable along the figure independently of its height.

These and further objects and advantages of the present invention will become more apparent upon reference to the following specification, appended claims and drawings.

DETAILED DESCRIPTION OF THE DRAWINGS

Reference will now be made in detail to a present preferred embodiment of the invention, an example of which is illustrated in the accompanying drawings.

Figure 1C:
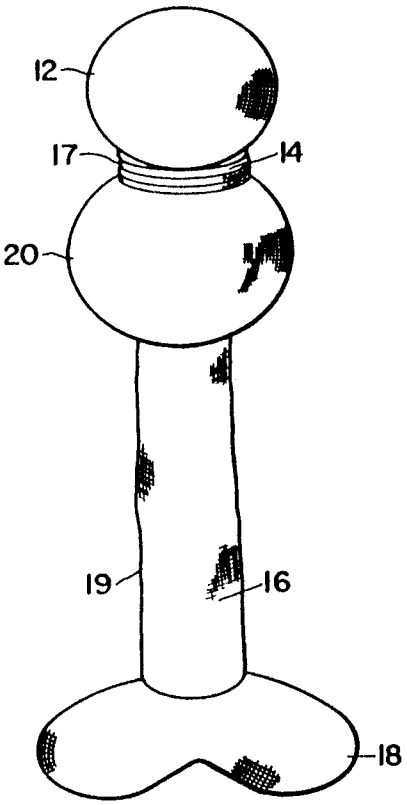
FIGS. 1A, 1B and 1C are schematic representations of a play toy figure according to the present invention illustrating the adjustable height of the figure and the location of the body portion of the figure at adjustable positions therealong independently of the height of the figure.
Figure 1B:
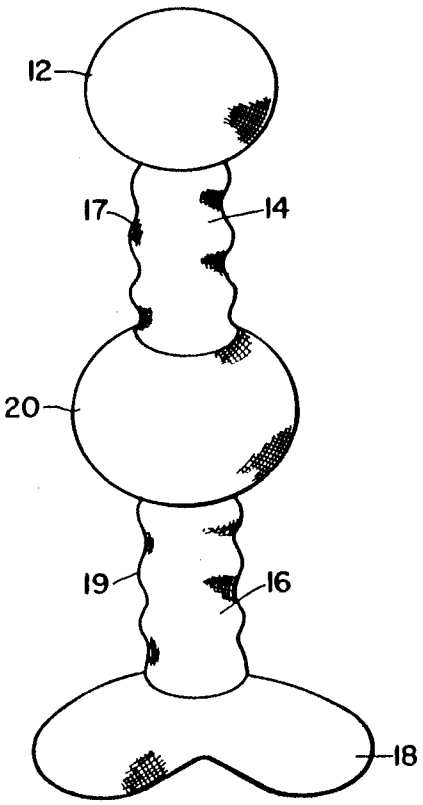
Figure 1A:
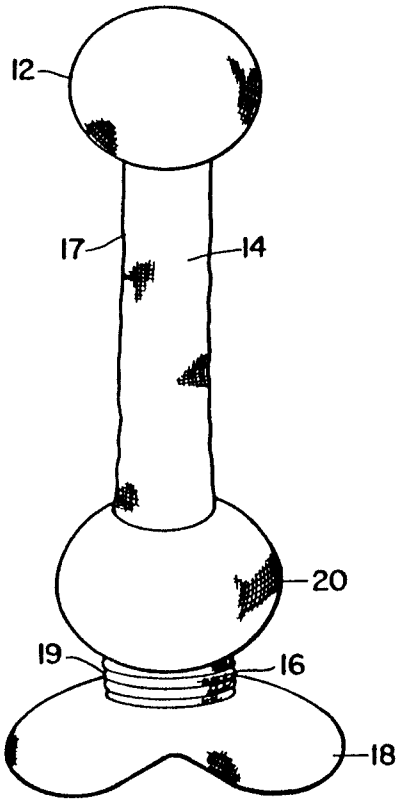

Referring now to the drawings, particularly FIGS. 1A, 1B and 1C, there is illustrated a play toy figure according to the present invention and generally designated 10. Play toy FIG. 10 includes head, neck, leg, and base portions 12, 14, 16 and 18, respectively and a body portion 20 which is moveable along the figure portion between the head and base portions, hereafter sometimes called the intermediate portion. It will be appreciated that these various portions are preferably formed of decorative material, and that the head, body and base portions, 12, 20 and 18, respectively can be stuffed or not and provided with various features. For example, head portion 12 may be enlarged and stuffed and provided with one or more facial features such as eyes, ears, nose and a mouth affording various facial characteristics. Similarly, the base portion 18 and body portion 20 can be decorated and/or stuffed as desired. Neck portion 14 comprises an overlay 17 of material, preferably a sheath of decorative fabric, connected between the head and body portions, 12 and 20, respectively. Similarly, leg portion 16 comprises an overlay 19 of material, preferably a sheath of decorative fabric, connecting between the base portion 18 and body portion 20. As noted above, the figure is extendable to a certain height, and, when extended to that maximum height, the material overlay 17 and 19 on the neck and leg portions 14, and 16, respectively, have sufficient length such that the body portion 20 may be disposed adjacent the base portion 18 or the head portion 12 whereby one overlay material is gathered and the other overlay material is extended to its maximum extent. This is illustrated by a comparison of FIGS. 1A, 1B and 1C wherein, in FIG. 1C, the material overlay 19 for the leg portion 16 is extended to a maximum extent when the figure is at its maximum height and the body portion 20 lies adjacent the head portion 12. It will be appreciated that the material overlay 17 will be at its maximum extent when the body portion 20 is at its lowermost position adjacent base portion 18.

Figure 2:
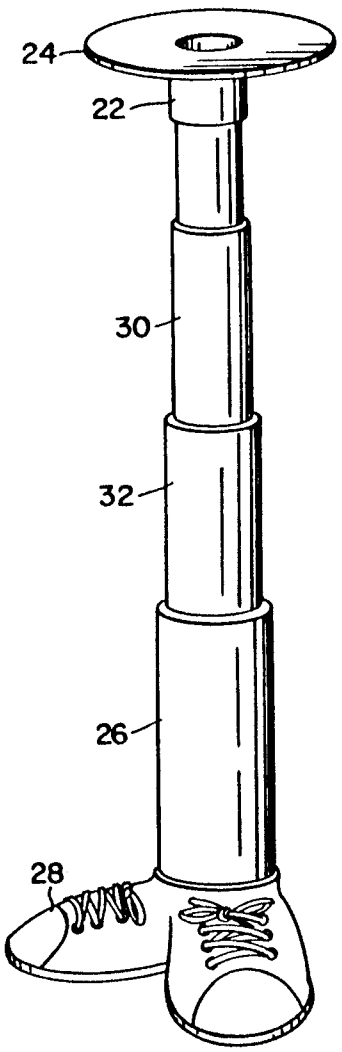
FIG. 2 is a schematic illustration of the telescopic sections within the body of the play toy figure.

Referring now to FIG. 2, the telescopic sections which form the structural portion of the toy figure and by which the toy figure is extended and retracted are illustrated. Particularly, the telescopic sections include a head section 22 carrying a head mounting flange 24, and a base section 26 carrying a base 28. While the head section 22 and base section 26 may be telescopically receivable, one within the other, whereby the toy figure may include only two telescoping sections, one or more intermediate telescopic sections are preferred. Thus, in FIG. 2, two additional telescopic sections 30 and 32 are disclosed intermediate the head and base sections 22 and 26, respectively. As illustrated, the telescopic sections preferably comprise cylindrical sections having various diameters so that the sections are telescopically receivable one within the other. The upper ends of the sections have radially inwardly directed flanges 34 (FIG. 5) which, in conjunction with friction pads to be described, form stops whereby the telescopic sections cannot be pulled apart.

Figure 3:
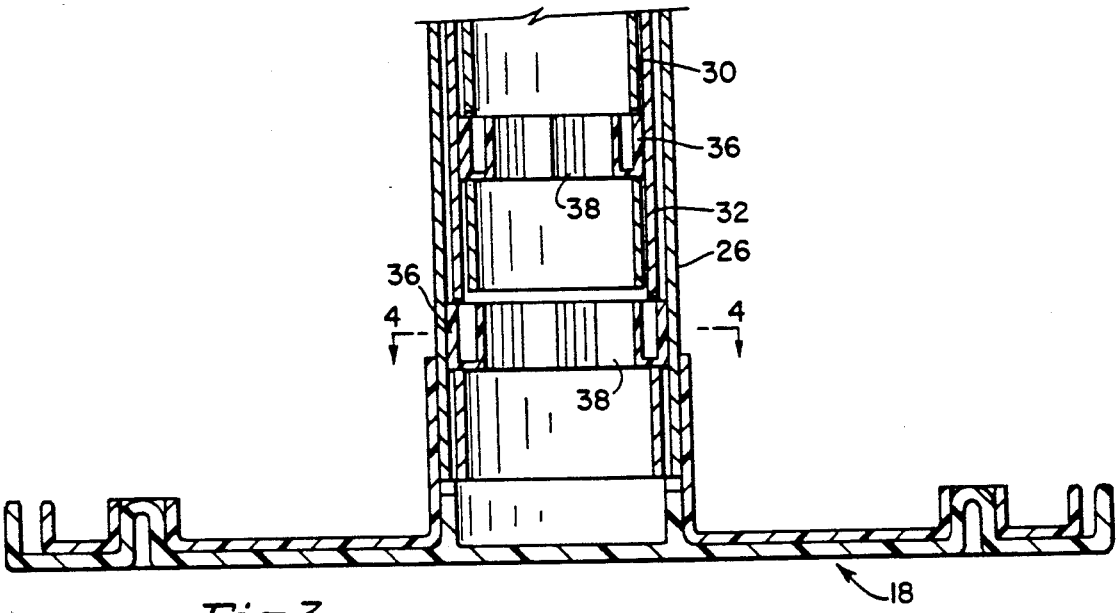
FIG. 3 is an enlarged fragmentary cross-sectional view of the base portion of the toy figure illustrating the friction pads and the telescopic sections.
Figure 4:
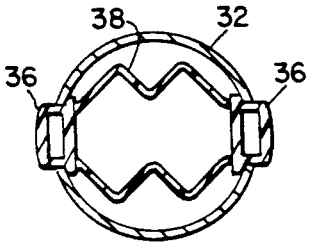
FIG. 4 is a cross-sectional view thereof taking generally about on line 4—4 in FIG. 3.

Referring to FIGS. 3 and 4, there is provided for each telescopic section other than the base section, friction pads 36 which extend through slots adjacent the bases of the sections. For example, as illustrated in FIGS. 3 and 4, friction pads 36 extend through slots for engagement with the inner surfaces of the overlying telescopic section. The friction pads 36 are biased in a radially outward direction sufficient such that the friction contact between the pads along the inner surfaces of the overlying telescopic section maintain the telescopic sections in adjusted positions. The bias may be provided by flexible generally Z-shaped plastic sections 38 as illustrated in FIG. 4. The bias may be provided otherwise, for example, by springs extending diametrically between the pads 36.

Figure 5:
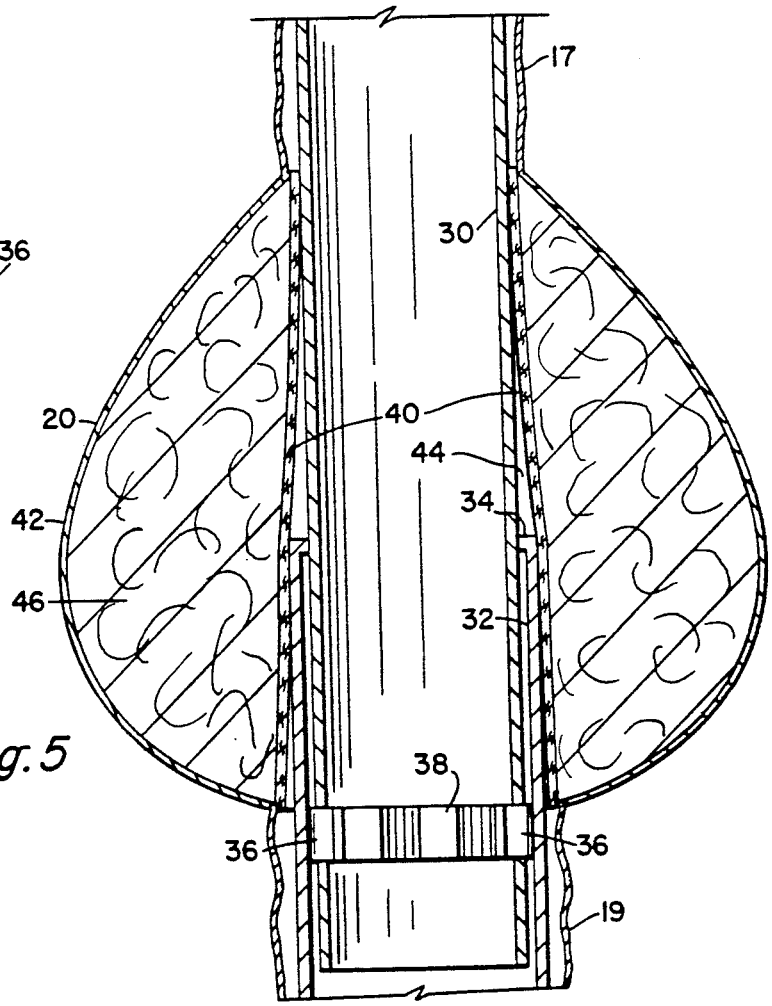
FIG. 5 is an enlarged fragmentary cross-sectional view illustrating the body portion and its frictional engagement with telescopic sections of the toy figure.

Referring now to FIG. 5, body portion 20 is illustrated at any selected position along the telescopic sections, for example, along the sections 30 and 32. Body portion 20 includes an inner sleeve 40 which receives the telescopic sections, in this instance, sections 30 ad 32. An outer covering 42 defines with the inner sleeve 40 an annular space 44 in which resilient stuffing material 46 is disposed. In this form, material 46 is stuffed sufficiently tightly within the chamber 44 and is itself sufficiently resilient such that sleeve 40 has a continuous radially inward bias applied to it causing it to frictionally engage along the outer surfaces of telescopic sections 30 and 32. Consequently, it will be appreciated that body portion 20 can be displaced along the telescopic sections into selected adjusted positions with the frictional engagement between the inner sleeve 40 and the telescopic sections at each adjusted position of body portion 20 along the figure maintaining the body portion 20 in that selected adjusted position. Note also that the fabric portions 17 and 19 which interconnect the body portion with the head and base portions 12, and 18, respectively, have sufficient length such that when the figure is extended with the head and base portions a maximum distance apart, the body portion 20 may be disposed along the intermediate portion adjacent either the head portion 12 or base portion 18.

Figure 6:
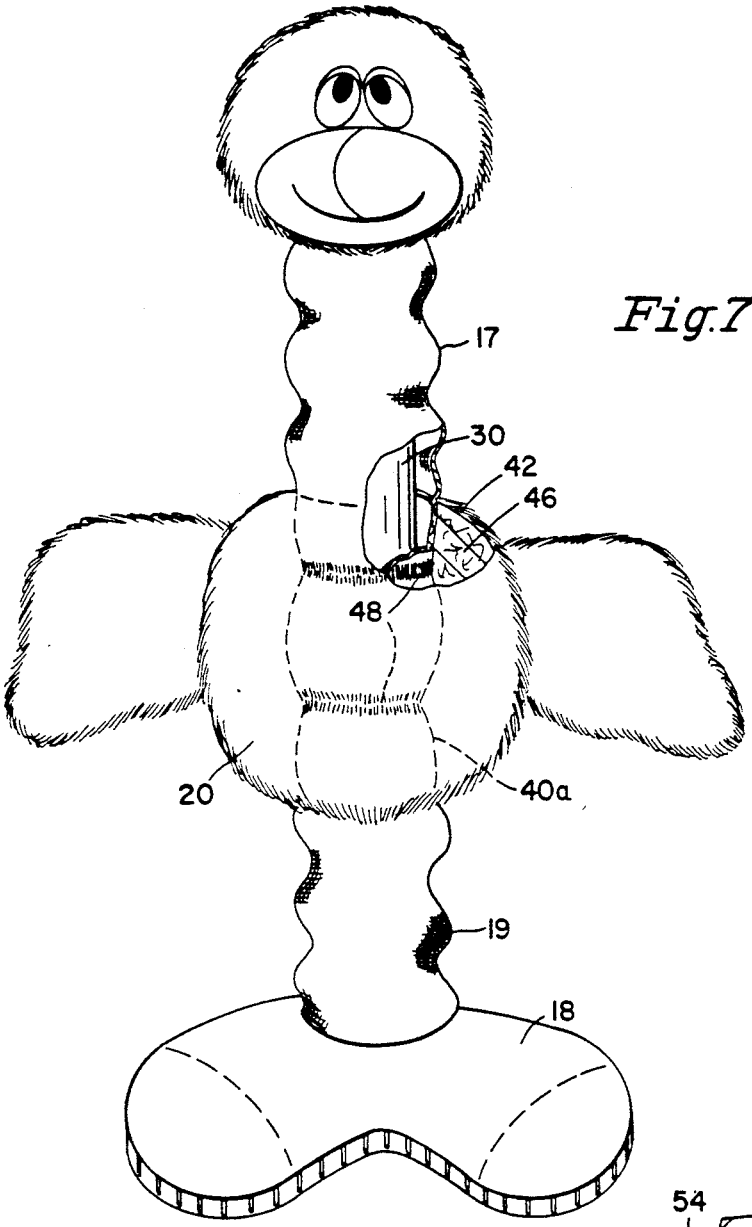
FIG. 6 is a schematic view of a toy figure hereof illustrating another embodiment of the inner sleeve for maintaining the body portion in adjusted position along the telescopic sections.

In an alternative embodiment illustrated in FIG. 6, elastic material 48 may be sewn into an otherwise inelastic sleeve 40*a* at axially spaced locations therealong. In this manner, the elastic material 48 gathers the sleeve material 40*a* around the telescopic sections providing the necessary frictional contact between the sleeve and sections to enable the body portion to be retained in a selected adjusted position along the telescopic sections. As a further alternative, sleeve 40 can be formed entirely of elastic material such that the frictional engagement between the elastic sleeve and telescoping sections maintains the body portion in the selected position along the height of the figure.

Figure 7:
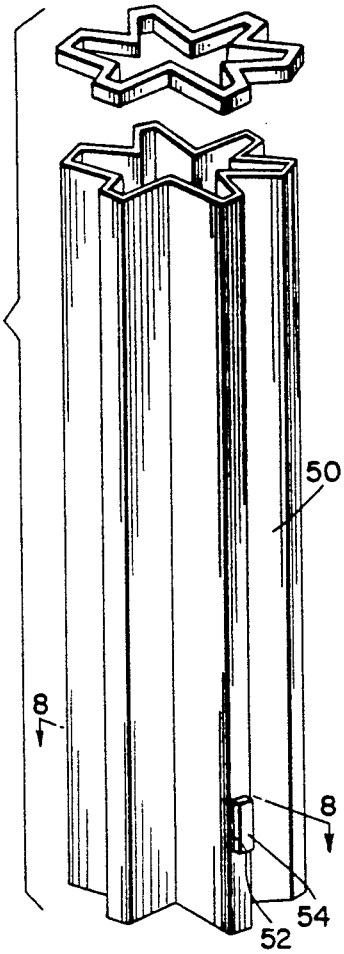
FIG. 7 is a perspective view of a further form of telescopic section.
Figure 8:
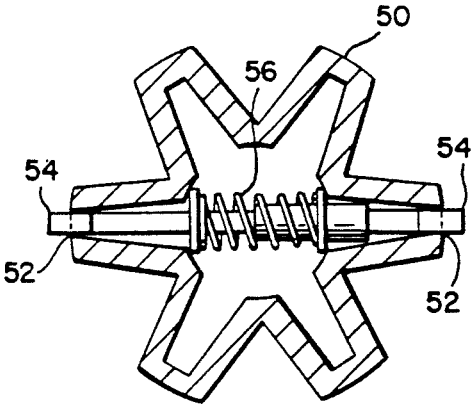
FIG. 8 is a cross-sectional view thereof taken about on line 8—8 in FIG. 7.

Referring now to FIGS. 7 and 8, it will be appreciated that the telescopic sections may have cross-sectional configurations other than the cylindrical configuration illustrated in FIG. 2. For example, square, rectangular, or other configurations may be provided and, in FIGS. 7 and 8, telescopic sections having a star-shaped cross-section are illustrated at 50. Also, adjacent the lower end of each telescoping section 50 there is provided an opening 52 for receiving a friction pad 54. The pads 54 are diametrically opposed to one another and a spring 56 is provided within the telescopic section to bias the pads 54 in a radially outward direction. The pads 54, of course, engage the inner surface of the overlying telescopic section to frictionally retain the telescopic sections in adjusted position.

Figure 9:
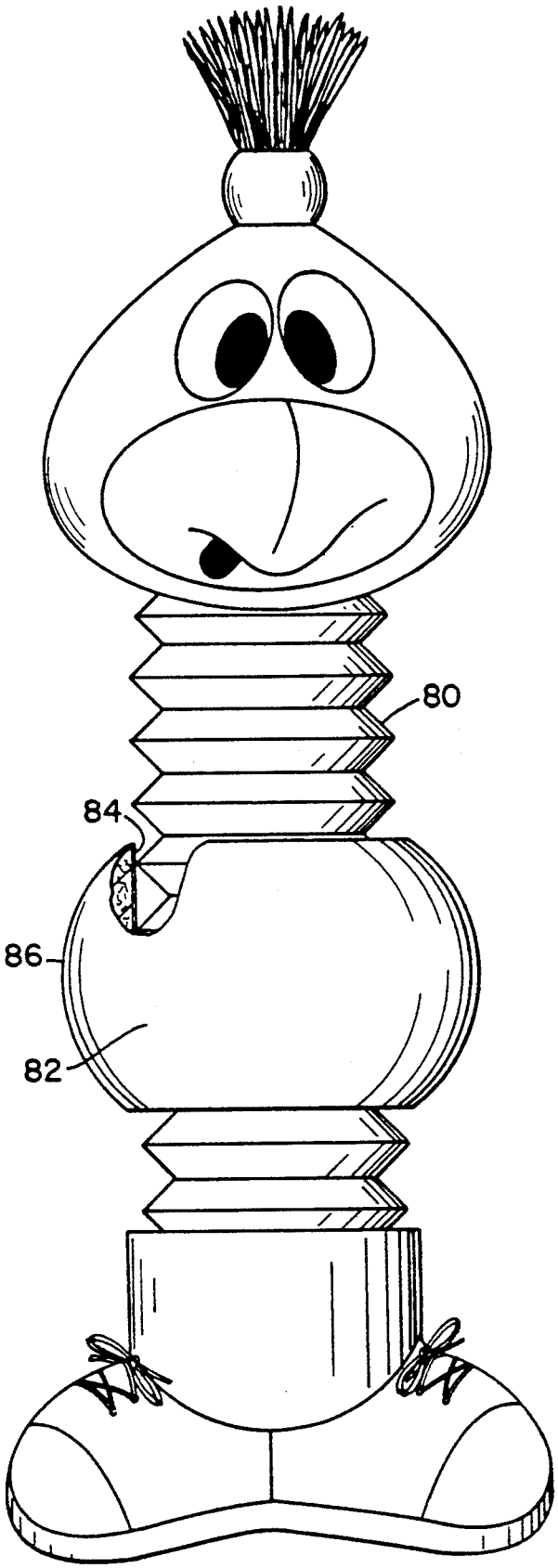
FIG. 9 is a front elevational view of a further embodiment of the play toy figure according to the present invention.

Referring now to FIG. 9, there is illustrated a further form of a play toy figure according to the present invention, including head, neck and base portions and a body portion as in the previous embodiment. In this form, however, instead of telescoping sections whereby the head and base portions are movable toward and away from one another, there is provided a bellows 80 interconnecting the head and base portions. The bellows per se is of well-known construction and is a biased bellows which enables the bellows to maintain itself in any desired extended or retracted or closed position. That is, movement of the head and base portions by extension of the bellows to a predetermined distance one another causes the bellows to maintain that position. Likewise, movement of the head and base portion toward one another with the bellows contracting, causes the bellows to maintain the head and base portions in the retracted position relative to one another. The bellows configuration also enables the head and feet to move out of vertical alignment with each other to simulate a more realistic positioning of the head, body, and feet.

In this embodiment, the body section 82 is similar to the body portion 20 previously described with respect to the embodiment hereof illustrated in FIG. 5. Thus, the body portion 82 includes an inner sleeve 84 and has an outer covering 86 defining an annular space in which resilient stuffing material is disposed. The inner sleeve 84 may be elastic or the stuffing may have such resiliency that the inner sleeve 84 frictionally engages along the outer surfaces of the bellows 80. The engagement between the sleeve 84 and the ridges of the bellows construction is sufficient to maintain the body portion 82 in adjusted axial position along the bellows as desired, yet at the same time enables the body portion 82 to slide along the bellows into a new adjusted position.

Consequently, it will be appreciated that there is provided in accordance with this invention a play toy figure adjustable in height and having an intermediate body portion slidable along the figure into selected adjusted positions. The movement of the body portion is independent of the height adjustment of the figure and at all times during any height adjustment and/or movement of the body portion along the figure, the figure retains its characteristic pleasing appearance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A play toy comprising:

a toy body having a plurality of generally upright sections telescopically receivable one with the other, one of said sections having a base portion at its lower end and another of said sections having an upper portion whereby, upon telescopic movement of said sections, said upper portion and said base portion are movable toward and way from one another to render the play toy shorter or taller, respectively;

means engageable between said sections for releasably retaining said sections in selected telescopically adjusted positions relative to one another whereby said upper portion and said base portion are disposable in selected adjusted distances relative to one another;

a body portion moveable along said sections independently of the telescopic movement of said sections and toward and away rom each of said upper portion and said base portion;

means cooperable between said body portion and said sections for releasably retaining said body portion in selected adjusted positions along said sections;

said cooperable means including a sleeve extending about at least one of said sections together with means for biasing at least a portion of said sleeve in an inward direction toward said one section for frictionally engaging said one section; and said biasing means comprising a resilient material carried by said body portion externally of said sleeve providing a radially inwardly directed force on said sleeve portion to frictionally engages said sleeve portion against said one section and thereby retain said body portion at selected elevations along said play toy between said upper portion and said base portion.

2. A play toy comprising:

a toy body having a plurality of generally upright sections telescopically receivable one with the other, one of said sections having a base portion at its lower end and another of said sections having an upper portion whereby, upon telescopic movement of said sections, said upper portion and said base portion are movable toward and way from one another to render the play toy shorter or taller, respectively;

means engageable between said sections for releasably retaining said sections in selected telescopically adjusted positions relative to one another whereby said upper portion and said base portion are disposable in selected adjusted distances relative to one another;

a body portion moveable along said sections independently of the telescopic movement of said sections and toward and away from each of said upper portion and said base portion;

means cooperable between said body portion and said sections for releasably retaining said body portion in selected adjusted positions along said sections;

said cooperable means including a sleeve extending about at least one of said sections together with means for biasing at least a portion of said sleeve in an inward direction toward said one section for frictionally engaging said one section; and said biasing means including an elastic material carried by said sleeve portion for biasing said sleeve portion radially inwardly against said one section, thereby retaining said body portion at selected elevations along said sections between said upper portion and said base portion.

3. A play toy comprising:

a toy body having upper, lower and intermediate sections, said intermediate section connecting between said upper and lower sections and including a biased bellows whereby said upper and lower sections are movable toward and away from one another, with said bellows maintaining the upper and lower sections at selectively adjusted positions relative to one another;

a body portion movable along said intermediate bellows section independently of the movement of the upper and lower sections toward and away from one another whereby the body portion may be displaced into a selected adjusted position along the bellows of said intermediate section;

means cooperable between said body portion and said intermediate section for releasably retaining said body portion in selected adjustable positions along said intermediate section;

said cooperable means including a sleeve extending about said intermediate section together with means for biasing at least a portion of said sleeve in an inward direction toward said intermediate section for frictionally engaging said intermediate section; and said biasing means comprising a resilient material carried by said body portion externally of said sleeve providing a radially inwardly directed force on said sleeve portion to frictionally engage said sleeve portion against said intermediate section and thereby retain said body portion at selected elevations along said play toy between said upper and lower sections.

4. A play toy comprising:

a toy body having upper, lower and intermediate sections, said intermediate section connecting between said upper and lower sections and including a biased bellows whereby said upper and lower sections are movable toward and away from one another, with said bellows maintaining the upper and lower sections at selectively adjusted positions relative to one another;

a body portion movable along said intermediate bellows section independently of the movement of the upper and lower sections toward and away from one another whereby the body portion may be displaced into a selected adjusted position along the bellows of said intermediate section; and means cooperable between said body portion and said intermediate section for releasably retaining said body portion in selected adjustable positions along said intermediate section;

said cooperable means including a sleeve extending about said intermediate section together with means for biasing at least a portion of said sleeve in an inward direction toward said intermediate section for frictionally engaging said intermediate section; and said biasing means including an elastic material carried by said sleeve portion for biasing said sleeve portion radially inwardly against said intermediate section, thereby retaining said body portion at selected elevations along said intermediate section between said upper and said lower section.

* * * * *